US007143447B2

(12) United States Patent
Fleischmann

(10) Patent No.: US 7,143,447 B2
(45) Date of Patent: Dec. 5, 2006

(54) FINGER PROTECTOR

(76) Inventor: Endrik Fleischmann, Erlback 8, Weichs (DE) 85258

( * ) Notice: Subject to any disclaimer, the term of this patent is extended or adjusted under 35 U.S.C. 154(b) by 0 days.

(21) Appl. No.: 10/528,774

(22) PCT Filed: Sep. 22, 2003

(86) PCT No.: PCT/EP03/10539

§ 371 (c)(1),
(2), (4) Date: Apr. 14, 2005

(87) PCT Pub. No.: WO2004/028282

PCT Pub. Date: Apr. 8, 2004

(65) Prior Publication Data

US 2005/0251078 A1 Nov. 10, 2005

(30) Foreign Application Priority Data

Sep. 23, 2002 (DE) ..... 102 44 236

(51) Int. Cl.
*A41D 13/08* (2006.01)
*A41D 19/00* (2006.01)

(52) U.S. Cl. ..... 2/16; 2/163

(58) Field of Classification Search ..... 2/16, 2/20, 161.1, 161.6, 163
See application file for complete search history.

(56) References Cited

U.S. PATENT DOCUMENTS 4,727,862 A 3/1988 Waddell et al.
6,058,503 A * 5/2000 Williams ..... 2/16
6,065,150 A * 5/2000 Huang ..... 2/20
6,202,217 B1 * 3/2001 Karall ..... 2/161.6
6,557,177 B1 * 5/2003 Hochmuth ..... 2/159
2002/0073477 A1 * 6/2002 Hochmuth ..... 2/161.1
2004/0148675 A1 * 8/2004 Powell ..... 2/16
2006/0048259 A1 * 3/2006 Keppler et al. ..... 2/21

* cited by examiner

*Primary Examiner*—Katherine M. Moran
(74) *Attorney, Agent, or Firm*—Nixon & Vanderhye P.C.

(57) ABSTRACT

The invention relates to a finger protector embodied in two pieces and particularly for application in sports gloves, primarily in goalkeepers' gloves. The finger protector comprises an outer piece (2) and an inner piece (3). The outer piece (2) has a midsection (22) with lateral straps (23) interconnected by transverse webs (24), as well as an end part (21). The inner piece (3) has tie webs (33) on both sides thereof, which are interconnected by expanding webs (34), with an end part (31) moreover being arranged on the inner piece (3). In the assembled state, the expanding webs (34) of the inner piece (3) engage in the transverse slots between the transverse webs (24) on the outer piece (2), such that the finger protector is movable in one direction for bending the finger such as for making a fist and locks in the opposite direction, in order to prevent excessive stretching of the finger in the direction towards the back of the hand. In addition the invention furnishes a method for manufacturing such a finger protector.

7 Claims, 7 Drawing Sheets

Fig. 7a
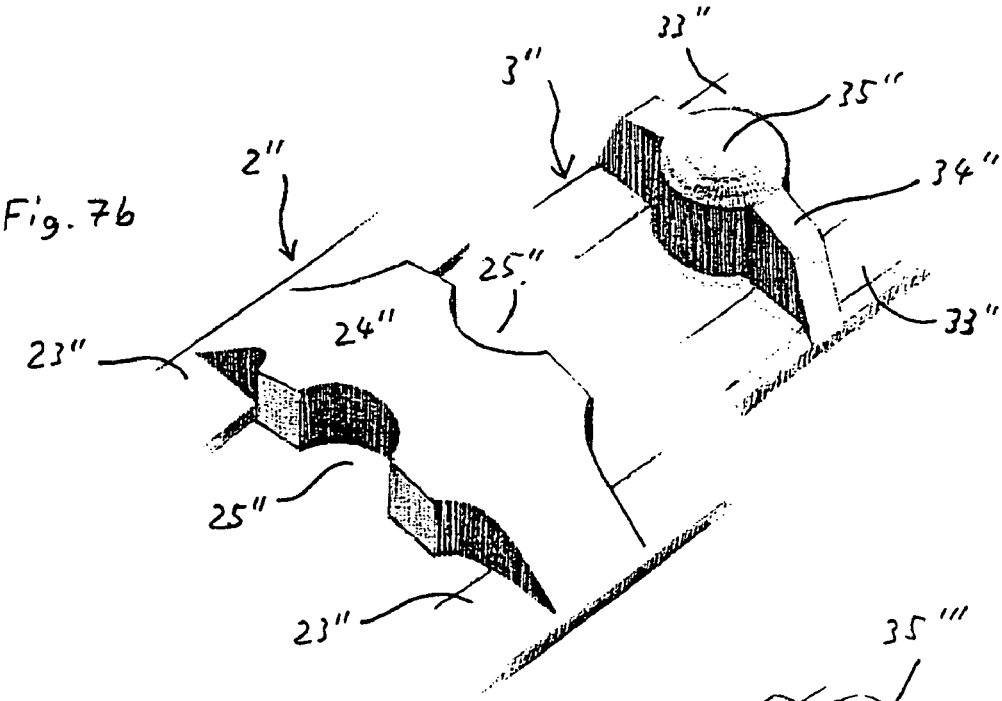
Fig. 7b
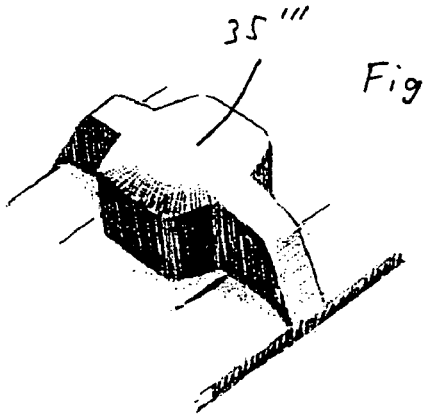
Fig. 8
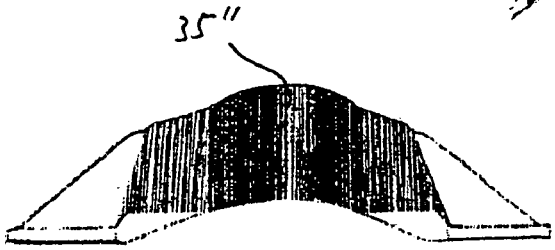
Fig. 9a
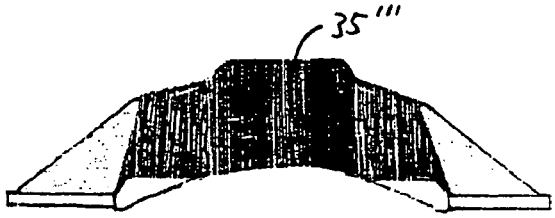
Fig. 9b

FINGER PROTECTOR

This application is the US national phase of international application PCT/EP2003/010539 filed 22 Sep. 2003 which designated the U.S. and claims benefit of DE 10244 236.3, dated 23 Sep. 2002, the entire content of which is hereby incorporated by reference.

Such finger protectors have the purpose of ensuring improved protection for the single fingers. They are applied in goalkeepers' gloves, motorcycle gloves, carving gloves, working gloves or the like, wherein they should—besides the protective effect for the associated finger—obstruct the natural function of the single finger as little as possible. The example of a goalkeeper's glove shows that there is a particular danger for the single finger particularly when a vigorously shot ball hits the extended finger in a line with the finger's longitudinal extension. Another source of risks are external influences such as, e.g., upon impact on goal posts or by other players who might step on the goalkeepers' hand with their cleats. Considerable injuries may occur in such cases.

In practice a design of such finger protectors is known wherein it is embodied in two pieces. The finger protector comprises an outer piece with an elongate, raised midsection and laterally protruding planar edges or straps. In the midsection, spaced-apart transverse slots are formed which are engaged by expanding webs of an inner piece arranged inside the raised midsection of the outer piece. The expanding webs of the inner piece are interconnected on both sides by tie webs. In an assembled position, this design results in a curving bias, for the expanding webs press the edges of the transverse slots apart. If a load in the sense of an excessive dilation in the direction towards the back of the hand occurs in a glove equipped with this finger protector, the expanding webs are subjected to pressure, with this pressure being transmitted by the edges of the transverse slots. The pull reaction forces occurring in the process are absorbed by the straps on the outer piece and the tie webs on the inner piece. The straps are customarily planar so as not to additionally oppose a bend of the base part through an inherent resistance, but rather will be curved in their plane in the event of such a bend, for example when making a fist.

One drawback with these known finger protectors is particularly the complex manufacture. Thus the inner and outer pieces are formed separately in different molding tools, with a separate tool being necessary for every finger length, i.e., every outer-piece length. The outer piece has one end part at each end, whereas the inner piece merely consists of the two tie webs and the transversely positioned expanding webs connecting the latter. These inner pieces are accordingly injection molded in such a manner that several injection channels attack on at least one longitudinal side, i.e., on one tie web, for introducing the injection molding compound into the mold. This does, however, have the disadvantage that the injection molded material comes to meet inside the workpiece, possibly resulting in locations of reduced strength owing to a non-optimal association of the material in these locations. The inner pieces with their delicate shape may therefore only be manufactured with considerable complexity.

In addition at least two complete molding tools are necessary in order to manufacture the components of the finger protector for only one finger length; which is a drawback in view of the tool costs. Moreover it is complex to correctly allocate the parts thus injection molded to each other, as they arrive from different locations of manufacture. This renders assembly difficult.

The invention is therefore based on the object of furnishing a finger protector which may be manufactured with reduced complexity. In addition it is moreover intended to furnish a simplified method for manufacturing this finger protector.

This object is attained through a finger protector having the features of claim 1, as well as through a method having the features of claim 6.

The invention is based on the novel idea of favorably configuring the two components of the finger protector, namely, the inner piece and the outer piece, in such a way that they may be injection molded more simply and in a single tool. For this purpose, an end part is provided on each one of these pieces, other than in the prior art where both end parts were arranged on the outer piece. This achieves as an essential advantage that both pieces may initially be manufactured to the maximum intended length, and shortening to the desired length in view of the associated finger may then readily be performed. It is therefore not necessary any more to manufacture both pieces in a separate tool exactly in accordance with the respective finger length.

Other than in the prior art where a special molding tool was thus required for each finger length, it is now possible in accordance with the invention to work with a single tool. An additional advantage is seen in the fact that cutting the pieces to the desired lengths may be performed together with separating the pieces from the sprue. Accordingly, the sprue must merely either be severed completely at the associated end side of the pieces, or optionally staggered by one, two, three, etc. sections within the pieces, with the sections remaining on the sprue then being waste material.

In a particularly preferred manner of proceeding, it is possible, e.g., to manufacture two outer pieces and two inner pieces each in one molding tool, wherein one outer piece and one inner piece each may then be present in parallel and in immediate vicinity of each other on one side of the centrally arranged sprue. Cutting these two associated pieces of the finger protector of the invention may then be performed in one cut, whereby both the inner piece and the outer piece are thus given the desired length in a single step.

The finger protector in accordance with the invention may thus be manufactured very economically and cost-effectively.

Advantageous developments of the invention are subject matter of the dependent claims.

Owing to the positive engagement of the transverse webs on the outer piece with the expanding webs of the inner piece in accordance with claim 2, advantageous lateral guidance avoiding torsion of a finger is achieved. Impacts in the longitudinal direction of the finger protector may moreover be attenuated better owing to a resulting larger contact surface between the outer and inner pieces, so that a lower compression per surface area occurs.

Here it was found to be particularly advantageous if the recesses at the transverse webs—and thus also the complimentarily formed enlarged portions on the expanding webs—have a substantially circular shape in the top view, for hereby manufacture may be simplified and functionality may be improved. Thus an injection molding tool having only one rounded section in this location with a constant radius may be furnished substantially more simply than a tool having a configuration formed of different contour elements. In addition there results a contact surface between the transverse webs and the expanding webs that is particularly good for transmitting the forces involved.

It is moreover also possible that the outer lateral edges of the straps and/or of the tie webs are given a rounded configuration, whereby on the one hand the material flow during the injection process may be improved, and on the other hand reliability of these pieces may be enhanced particularly with a view to their breaking strength. Stresses may moreover be absorbed better, so that it is also possible to better avoid fatigue phenomena in this location.

The method of the invention in accordance with claim 6 is in particular characterized by its low number of method steps for obtaining a completely assembled finger protector. Here only the provision of a single molding tool is necessary, whereby finger protectors of any desired length may be manufactured.

In a particular preferred realization, the molding tool is designed such that the inner and outer pieces are injection molded in the direction of length, i.e., in the direction of their longitudinal extension, which means that the injection molding material is introduced longitudinally through the straps or tie webs, respectively, to finally arrive at the respective end parts. In this way it is possible to avoid gate marks on the sides of the tie webs or of the straps, respectively, which has the further effect that the injection molding compound will not meet inside these pieces but in the range of the expanding webs or of the transverse webs, respectively. As these elements are, however, merely subjected to pressure and not to tension, possibly non-optimal fusion of the material at these interfaces is of substantially less practical importance for the performance of the finger protector in accordance with the invention, than was the case with interfaces in the straps and tie webs, respectively, in accordance with the prior art.

The invention shall in the following be explained in more detail through practical examples by referring to the figures of the drawing, wherein.

Figure 5A:
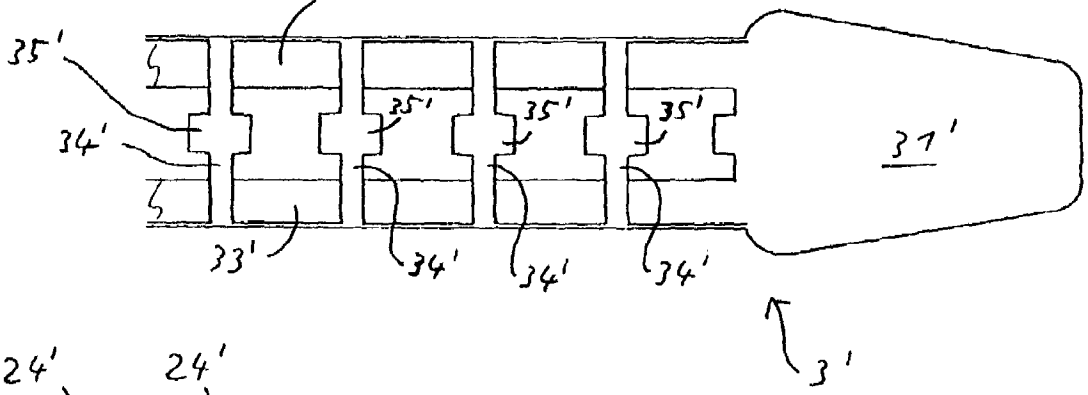
Figure 5B:
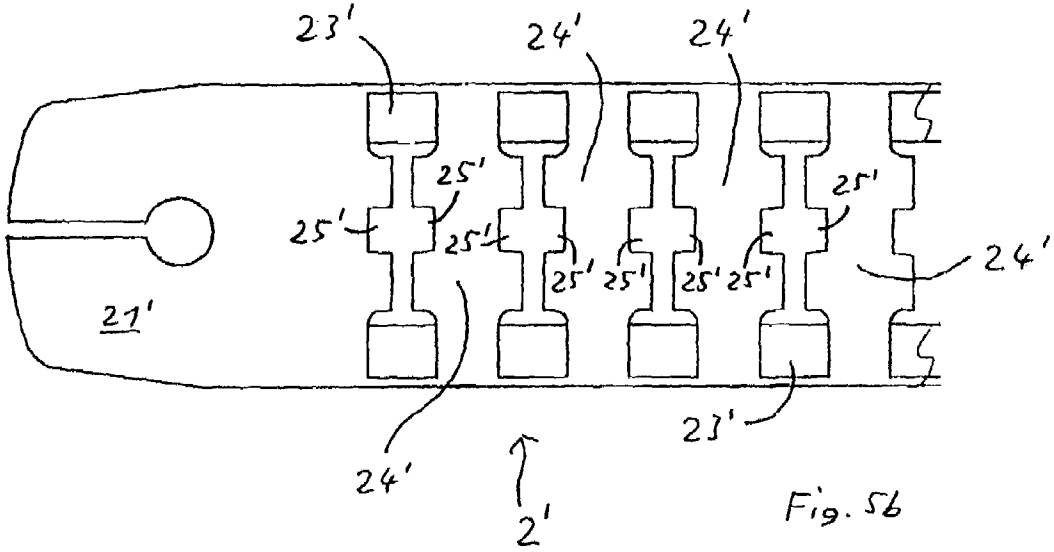
Figure 6:
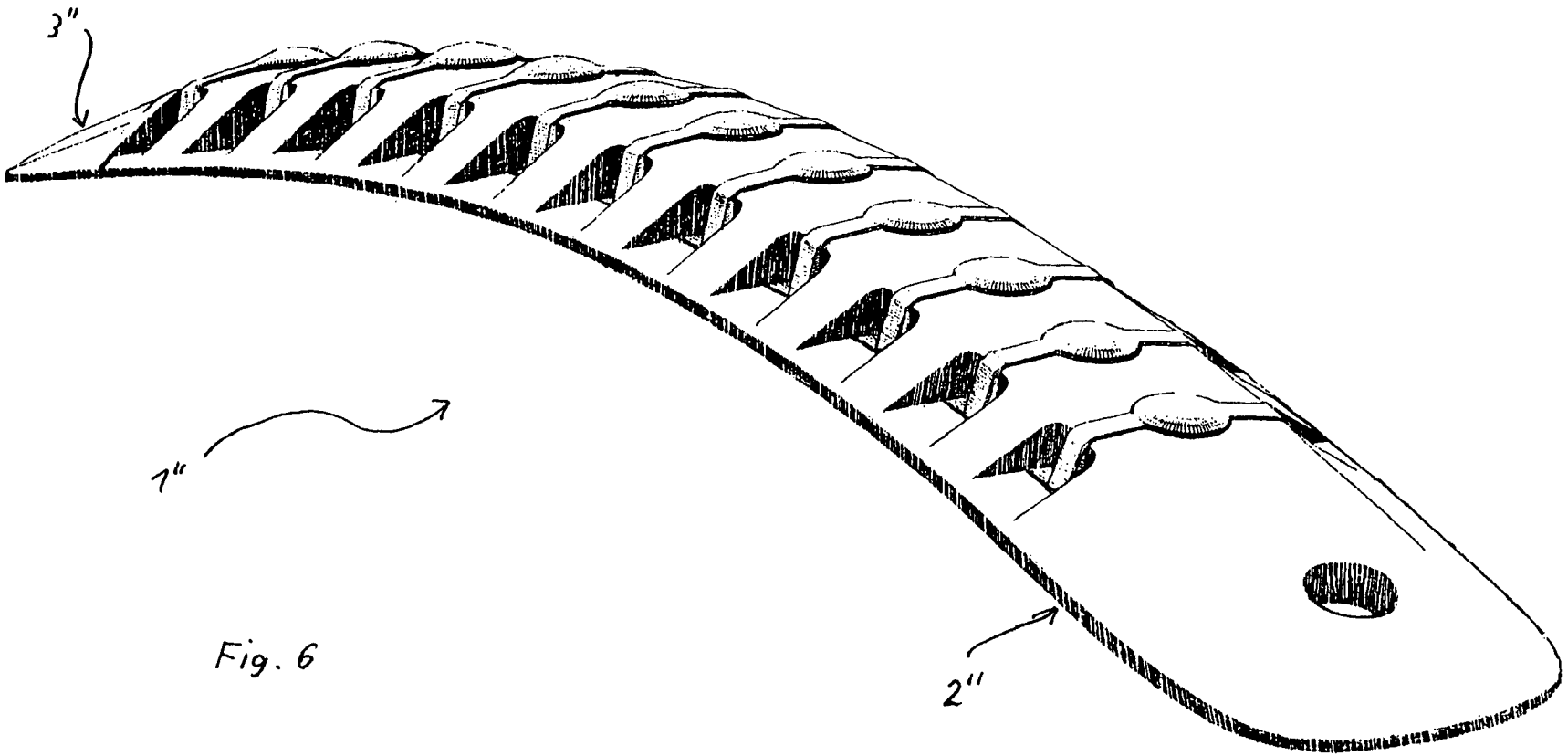

FIG. 5*a* is a top view of a part of an inner piece in a modified embodiment;

FIG. 5*b* is a top view of a partial region of an outer piece in the modified embodiment;

FIG. 6 is a perspective representation of another embodiment of a finger protector in accordance with the invention;

FIG. 7*a* is a perspective view of an expanding web in accordance with this further embodiment;

FIG. 7*b* is a perspective view of a transverse web in accordance with this further embodiment;

FIG. 8 is a perspective view of an expanding web of yet another embodiment;

FIG. 9*a* is a cross-sectional view of the expanding web in accordance with FIG. 7*a;*

Figure 10A:
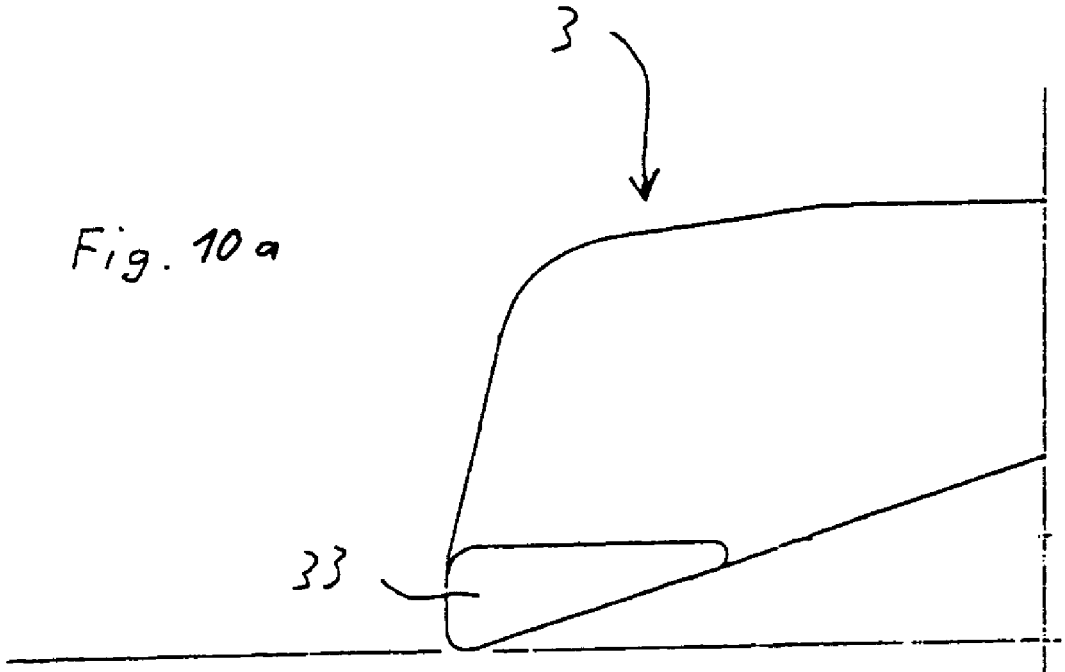

FIG. 9*b* is a cross-sectional view of an expanding web in accordance with the embodiment of FIG. 8;

FIG. 10*a* is a cross-sectional view of one half of the inner piece; and

Figure 10B:
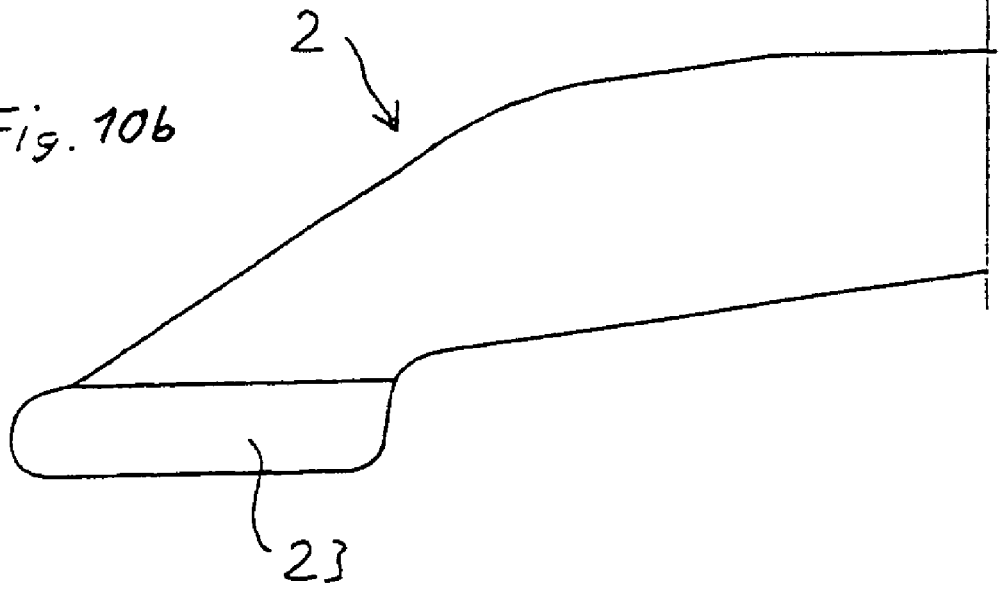

FIG. 10*b* is a cross-sectional view of one half of the outer piece.

In accordance with the representation in the figures, a finger protector 1 comprises one outer piece 2 and one inner piece 3 which engage in each other in the connected condition to form the finger protector 1.

The outer piece 2 has an end part 21 and a midsection 22. The midsection 22 contains two lateral straps 23 connected to each other by transverse webs 24, with the transverse webs 24 accordingly being spaced apart from each other by transverse slots.

The inner piece 3 has an end part 31 and a midsection 32. The elongate midsection 32 contains lateral tie webs 33 interconnected by expanding webs 34 which extend transversely to the longitudinal extension of the inner piece 3. In the assembled condition the expanding webs 34 engage in the transverse slots formed between the transverse webs 24.

Figure 1:
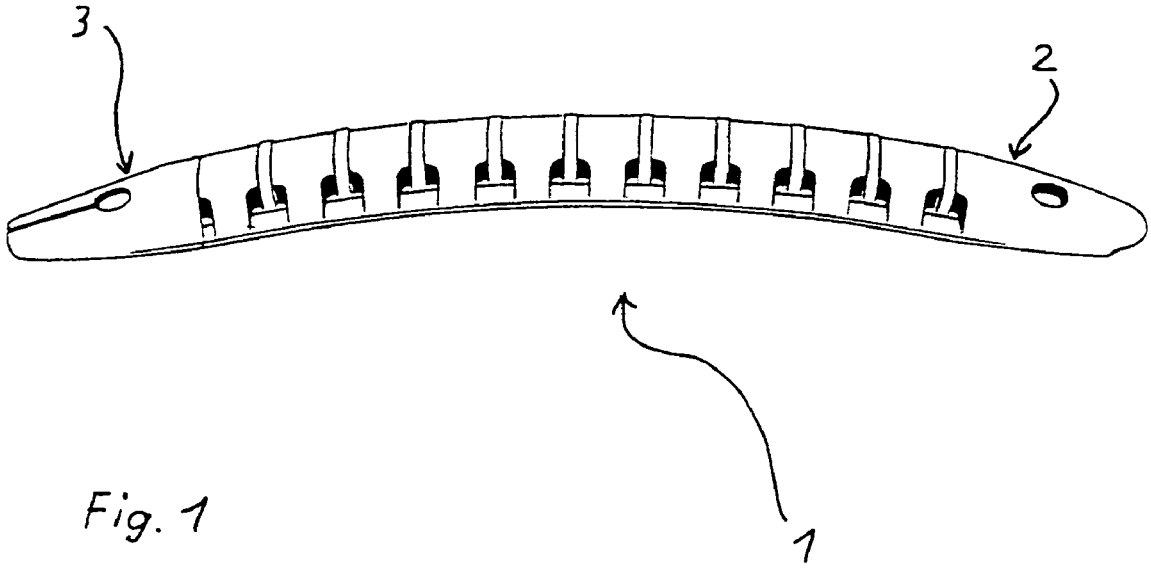
FIG. 1 shows a perspective representation of a finger protector in accordance with the invention.
Figure 2:
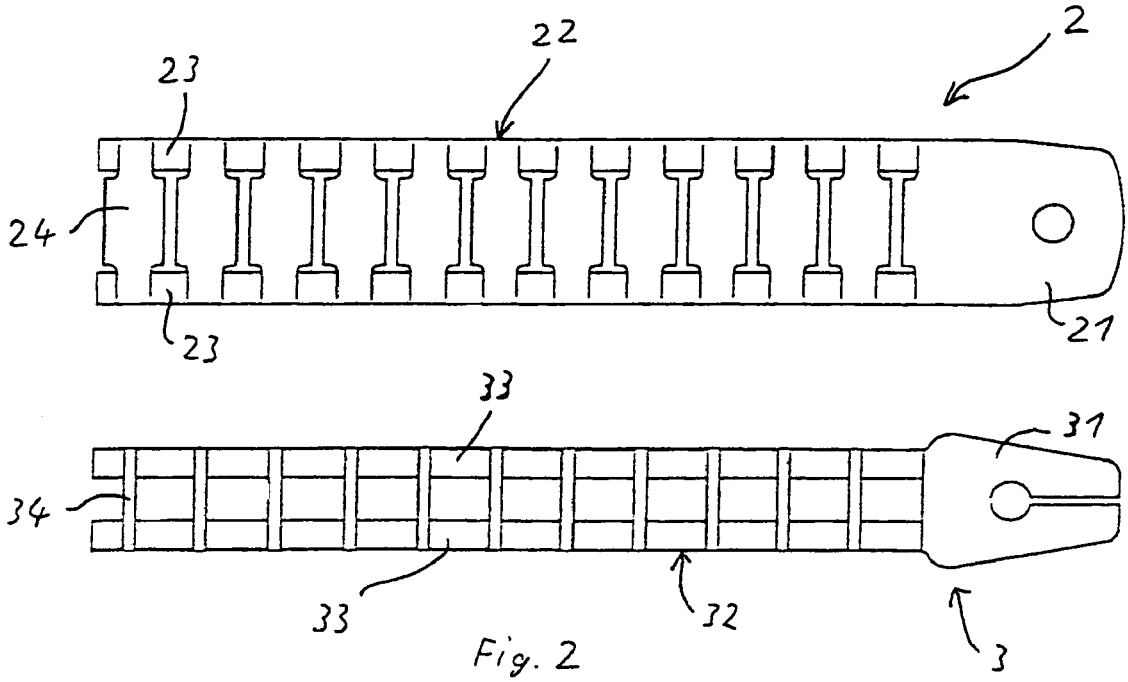
FIG. 2 shows the outer piece and the inner piece of the finger protector in the disassembled condition.
Figure 3:
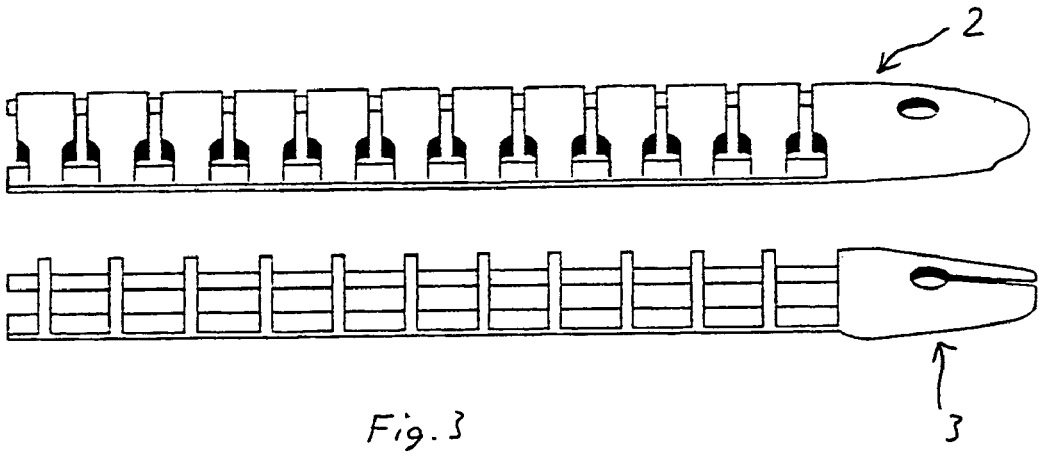
FIG. 3 shows the two components of the finger protector in an oblique lateral view.
Figure 4:
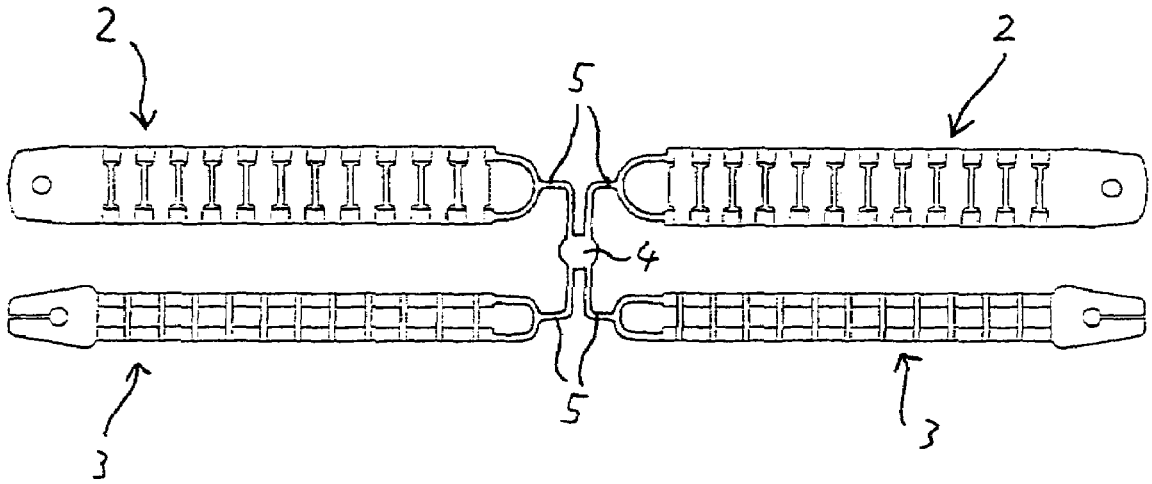
FIG. 4 is a top view of just-completed molded components of the finger protector in accordance with the invention, in which the sprue passages are visible.

FIG. 4 shows one example of an arrangement of the components of the finger protector 1 after the molding step. Apart from two outer pieces 2 and two inner pieces 3, the sprue 4 with sprue passages 5 is also represented.

FIGS. 5*a* and 5*b* show a modified embodiment of the outer piece 2' and inner piece 3', respectively, wherein transverse webs 24' each comprise a recess 25' in the center range symmetrically with the longitudinal axis of the outer piece 2'. On the inner piece 3', accordingly, expanding webs 34' are formed which also have in the center range, symmetrically with the longitudinal axis of the inner piece 3', enlarged portions 35' cooperating with the recesses 25' on the outer piece 2. The shapes of these recesses 25' and enlarged portions 35' are preferably adapted to each other, wherein it is also possible to employ other shapes differing from the shown shapes, e.g., triangular or octagonal.

Thus FIG. 6 shows in a perspective representation another embodiment for a finger protector 1", which has, in analogy with the other embodiments, an outer piece 2" and an inner piece 3" joined together.

In FIGS. 7*a* and 7*b* details of this finger protector 1" are shown. In the perspective view in accordance with FIG. 7*a*, an expanding web 34" is shown which connects two straps 33" of the inner piece 3" to each other. The expanding web 34" has an enlarged portion 35" which generally follows a circular contour in the top view.

A matching transverse web 24" is shown in FIG. 7*b* in a perspective representation. This transverse web 24" interconnects two straps 23" of the outer piece 2". As may be seen in this representation, one recess 25" each substantially having the form of a circle section is formed centrally when viewed in the transverse extension and on either side of the transverse web 24" when viewed in the longitudinal extension of the outer piece 2". The recess 25" has a shape that is complementary to the shape of the enlarged portion 25", so that the mutually facing walls of the expanding web 34" (including the enlarged portion 35") and of the transverse web 24" (including a recess 25") are present in full-surface contact in the assembled condition.

FIG. 8 shows another modified embodiment of an enlarged portion 35'". In accordance with this variant, the enlarged portion 35'" does not follow any substantially circular contour, but has flat side portions which are, however, provided with radii at the intersections. The recesses at the transverse webs of the outer piece (not represented) in turn have a shape complementary to these.

FIGS. 9*a* and 9*b* show cross-sectional views of the enlarged portions 35" and 35'" in order to make clear that these have a raised configuration in the respective embodiments, i.e., they protrude beyond the top edge of the respective associated transverse webs (also cf. FIG. 6). In the example shown in FIG. 9*a*, the protruding section of enlarged portion 35" has a substantially rounded shape when seen in cross-section, whereas the protruding portion of the enlarged portion 35'" in accordance with the representation in FIG. 9*b* is flattened. The choice of contour of the protrusion is, however, not determined by the shape of the enlarged portion in the top view, which means that the enlarged portion 35" might also just as well have a flattened configuration, etc.

FIGS. 10*a* and 10*b* show cross-sectional views of the inner piece 3 and outer piece 2, respectively, from which it may be seen that the straps 23 and the tie webs 33, respectively, may be rounded at their extreme lateral edges.

The invention claimed is:

1. Finger protector (1; 1"), particularly for a sports glove, comprising an outer piece (2; 2'; 2") and an inner piece (3; 3'; 3"), the outer piece (2; 2'; 2") including an elongate, raised midsection (22) with laterally protruding straps (23; 23'; 23") and an end part (21; 21'), wherein the midsection has transverse webs (24; 24'; 24") formed to be spaced apart from each other by transverse slots, with the inner piece (3; 3'; 3") having an elongate shape and on either side thereof tie webs (33; 33'; 33") interconnected through expanding webs (34; 34'; 34"), wherein an end part (31; 31') is arranged at the inner piece, and the expanding webs (34, 34'; 34") of the inner piece (3; 3'; 3") engage in the transverse slots of the outer piece (2; 2'; 2") such that the finger protector (1; 1") is movable in one direction for bending the finger such as for making a fist and locks in the opposite direction, in order to prevent excessive stretching of the finger in the direction towards the back of the hand.

2. Finger protector in accordance with claim 1, characterized in that the transverse webs (24'; 24") include a central recess (25'; 25") on the outer piece (2'; 2") such that the respective transverse slot is broadened in the center range, and that the expanding webs (34'; 34") of the inner piece (3'; 3") contain an enlarged portion (35'; 35"; 35'") complementary thereto in the center range, with the enlarged portions positively engaging the expanding in the recesses on the transverse webs.

3. Finger protector in accordance with claim 2, characterized in that the recesses (25") follow a substantially circular contour in the top view.

4. Finger protector in accordance with claim 1, characterized in that the outer lateral edges of the straps (23) have a rounded shape.

5. Finger protector in accordance with claim 1, characterized in that the outer lateral edges of the tie webs (33) have a rounded shape.

6. Method for manufacturing a finger protector (1; 1") in accordance with claim 1, characterized by comprising the steps:

furnishing a molding tool for the simultaneous manufacture of at least one respective inner and outer piece (2; 2'; 2", 3; 3'; 3"), injection molding the at least one inner and outer piece (2; 2'; 2", 3; 3'; 3"), cutting the sprue passage (4, 5) to the suitable length in accordance with the associated finger length by one cut through the inner and outer piece (2; 2'; 2", 3; 3'; 3"), and joining together the at least one inner and outer piece (2; 2'; 2", 3; 3'; 3") for manufacturing the finger protector (1; 1"), wherein the end parts (21; 21', 31; 31') have an opposed position.

7. Method in accordance with claim 6, characterized in that the molding tools have such a configuration that the inner and outer pieces (2; 2'; 2", 3; 3'; 3") are injection molded in the direction of their longitudinal extension.

* * * * *